US006267176B1

(12) United States Patent
Bolla et al.

(10) Patent No.: US 6,267,176 B1
(45) Date of Patent: Jul. 31, 2001

(54) WELD-FREE HEAT EXCHANGER ASSEMBLY

(75) Inventors: James David Bolla, Mission Vieio; Richard Brian Kennedy, Brea, both of CA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/502,389

(22) Filed: Feb. 11, 2000

(51) Int. Cl.[7] ..... F28F 3/02

(52) U.S. Cl. ..... 165/166; 165/170; 165/DIG. 387; 165/167

(58) Field of Search ..... 165/165, 166, 165/167, 146, 170, DIG. 387, DIG. 367

(56) References Cited

U.S. PATENT DOCUMENTS

| | | | | |
|---|---|---|---|---|
| 1,831,533 | | 11/1931 | Hubbard . | |
| 2,828,947 | * | 4/1958 | Hedbom | 165/170 |
| 2,834,582 | * | 5/1958 | Kablitz | 165/166 |
| 2,953,110 | * | 9/1960 | Etheridge | 165/146 |
| 2,961,222 | * | 11/1960 | Butt | 165/170 |
| 2,983,485 | | 5/1961 | Peterson . | |
| 3,262,496 | | 7/1966 | Bawabe . | |
| 3,967,354 | * | 7/1976 | Jaspers | 165/166 |
| 3,995,688 | | 12/1976 | Darm . | |
| 4,263,966 | | 4/1981 | Ostbo . | |
| 4,301,863 | * | 11/1981 | Bizzaro | 165/166 |
| 4,308,915 | * | 1/1982 | Sanders et al. | 165/167 |
| 4,442,886 | * | 4/1984 | Dinulescu | 165/166 |
| 4,596,285 | * | 6/1986 | Dinulescu | 165/166 |
| 4,714,107 | | 12/1987 | Adsett . | |
| 4,823,867 | * | 4/1989 | Pollard et al. | 165/166 |
| 4,848,450 | | 7/1989 | Lapkowsky . | |
| 4,860,824 | | 8/1989 | Foley et al. . | |
| 4,987,955 | | 1/1991 | Bergqvist et al. . | |
| 5,183,106 | * | 2/1993 | Stancliffe et al. | 165/166 |
| 5,383,516 | * | 1/1995 | Dinulescu | 165/166 |
| 5,573,060 | | 11/1996 | Adderley et al. . | |
| 5,832,993 | | 11/1998 | Ohata et al. . | |

* cited by examiner

*Primary Examiner*—Ira S. Lazarus
*Assistant Examiner*—Terrell McKinnon
(74) *Attorney, Agent, or Firm*—William J. Zak, Jr., Esq.

(57) ABSTRACT

A weld-free heat exchanger assembly core includes a plurality of stacked fin-plate assemblies. A separate enclosure bar is positioned at the end of each fin-plate assembly. A plurality of apertures are pre-drilled in the enclosure bars before assembly of the core. Once the core is assembled, it is brazed to form a unitary structure. Apertures formed in the inlet and outlet manifolds are aligned with apertures formed in the enclosure bars and fasteners are inserted into the aligned apertures. The fasteners serve to draw each manifold into tight engagement with a plurality of separate enclosure bars.

20 Claims, 9 Drawing Sheets

WELD-FREE HEAT EXCHANGER ASSEMBLY

BACKGROUND OF THE INVENTION

The present invention generally relates to heat exchanger assemblies of the type used in an aircraft environmental control system ("ECS"). Such heat exchangers are usually of the fluid-to-fluid type, either gas or liquid, and typically have a core assembly including alternating rows of heat transfer fins and plates. The rows are interposed to create multiple, hot and cold side passageways extending through the core assembly. The passageways may create a counter-flow, parallel flow or cross-flow heat exchange relationship between fluids flowing through the passageways. During operation, heat is exchanged between the fluids flowing through the core assembly.

Because an aircraft ECS often operates at, and generates within itself, extreme temperature and pressure conditions, the heat exchanger is subjected to the adverse effects of temperatures as well as the forces generated by operation of the aircraft. The heat exchanger is manufactured to function in such a hostile environment. Fin-plate type heat exchangers typically include a core and inlet and outlet manifolds. The core typically includes rows of fin assemblies and support plates that support as well as separate adjacent rows of fin assemblies. Each fin assembly is usually formed from one or more corrugated sheets and at least two fluid enclosure bars, which are bonded, typically by brazing, to a pair of support plates. After the components are assembled to form the core, the core is welded to the inlet and outlet manifolds. In order to build up a surface of solid material upon which to weld the manifolds, a butterpass weldment is first placed on the edges of the core.

When heat exchanger cores are subjected to the butterpass and/or general manifold weldment procedures, they may suffer certain drawbacks that increase the manufacturing costs and reduce the overall quality of the resulting heat exchanger. If the core is welded to the manifold, the size (i.e., gage) of the core material receiving the weld may be thicker than would otherwise be needed in order to support the weldment. This additional amount of core material can significantly increase the overall weight of the core assembly. Consequently, the weight of the aircraft is increased which, in turn, increases fuel consumption and increases aircraft operating costs.

If a conventional butterpass or similar weld is used to secure the heat exchanger components, and if there are initial stresses or flaws in the welds, some of the welds may fail. Consequently, the life cycle of the heat exchanger will be reduced.

There currently exists a need for a heat exchanger assembly that overcomes the drawbacks associated with welding the manifolds to the core.

SUMMARY OF THE INVENTION

This need is met by a heat exchanger assembly in accordance with the present invention. The heat exchanger assembly includes a core comprising a plurality of separate fin assemblies, wherein each adjacent pair of fins is separated from one another by a separate support plate. The fin assemblies form at least two fluid passageways extending through the core assembly, allowing heat to be transferred from a first fluid flowing through one passageway to a second fluid flowing through the second passageway. The support plates are positioned on either side of each fin assembly for supporting the fin assemblies in their proper positions while preventing fluid from leaking between flow passageways formed by adjacent fin assemblies. Enclosure bars preferably having pre-formed apertures are positioned at the ends of the fin assemblies and interposed support plates. The enclosure bars provide a framework for the fin assemblies and a support surface for attaching the manifolds to the core assembly. After the fin assemblies, support plates and enclosure bars are brazed together to form a unitary core assembly, the bars maintain proper separation of the support plates as well as allow attachment of the enclosure bars to the inlet and outlet manifolds Apertures in the enclosure bars are aligned with apertures in the manifolds and connection members, allowing a plurality of fasteners to establish a mechanical connection between the manifolds and the enclosure bars, creating is a weld-free heat exchanger assembly. Eliminating the assembly weldment procedure reduces, or even eliminates, heat exchanger scrap and/or repair time and damage costs often imparted when welding a conventional core assembly. Furthermore, by eliminating the various welding operations needed to attach the core to the manifolds, a common occurrence of reduced structural rigidity of the material located near the weld is eliminated. In addition, replacing the manifold to core weld joint with a mechanical attachment can provides a more robust heat exchanger assembly with respect to the thermal stresses present at the joint.

While the need for welds on the brazed core and at the core to manifold joint are eliminated in the present invention, it is considered within the scope of the present invention to construct the core components prior to brazing and/or construct the manifolds from a number of separate pieces that are welded together. Further welding may be performed on the heat exchanger assembly, other than the core to manifold joint, after the mechanical attachment is achieved. Alternatively, apertures may be formed in the enclosure bars after the core is brazed to form a unitary assembly.

DETAILED DESCRIPTION OF THE INVENTION

The present invention is embodied in a fluid-to-fluid heat exchanger assembly adaptable for use with or without an ECS and including a plurality of interposed fin and support plate assemblies forming a fin-plate type exchanger having at least two separate fluid passages. Support plates are preferably positioned on either side of each fin assembly. A plurality of separate enclosure bars are positioned at the ends of the fin assemblies. The fins, plates, support plates and enclosure bars are secured together by any well known non-welding process (e.g, brazing) to form a unitary core assembly. The manifold attachment flanges, complete with apertures ready to accept fasteners, are inherently created during the core assembly process. Inlet and outlet manifolds are mechanically connected to the enclosure bars by any well known fasteners (e.g., rivets, threaded bolts, studs, dead screws).

Figure 1A:
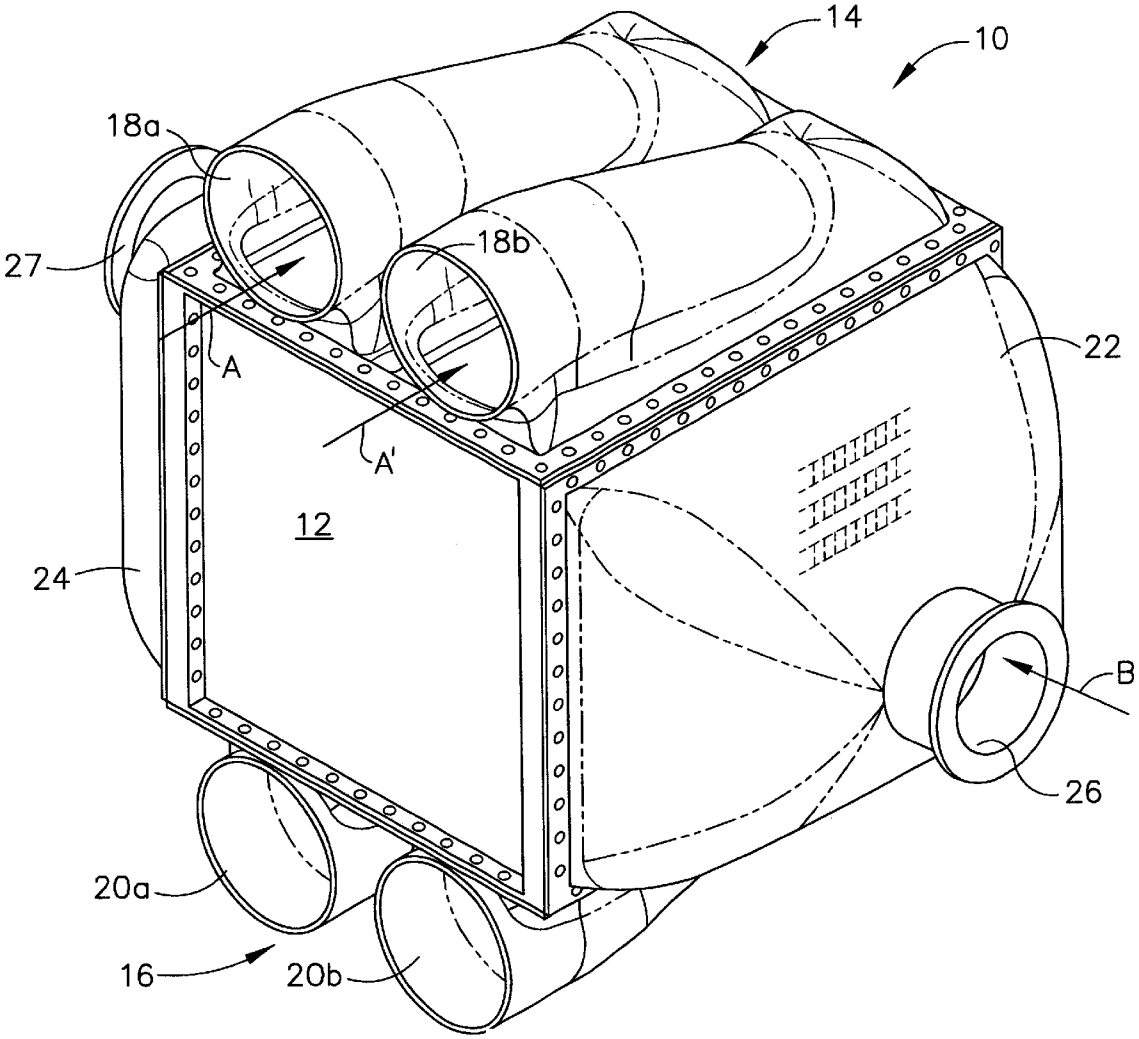
FIGS. 1*a* and 1*b* are perspective views of heat exchangers including differing manifolds, each formed in accordance with the present invention.

Attention is directed to FIG. 1*a*, wherein a heat exchanger is generally illustrated at 10. The heat exchanger 10 includes a core assembly 12, a first inlet manifold 14 attached to one side of core assembly 12, and a first outlet manifold 16 attached to an opposite side of core assembly 12. The first inlet manifold 14 includes a pair of inlet ports or openings 18*a* and 18*b*, respectively. Likewise, the first outlet manifold 16 includes a pair of outlet openings 20*a* and 20*b*, respectively. At least one first fluid passageway A begins with inlet opening 18*a* in the first inlet manifold 14, extends through core assembly 12, and exits through outlet opening 20*a* in the first outlet manifold 16.

It is within the scope of the invention to have one, two or more than two parallel fluid passageways A and A' each extending through core 12. A completely separate fluid passageway A' may extend parallel to fluid passageway A through core assembly 12 between inlet manifold opening 18*b* and outlet opening 20*b*. During use, a single fluid may flow though each of the parallel passageways A and A' or a first fluid could flow though fluid passageway A and at the same time a second, different fluid flow through passageway A'.

A second inlet manifold 22 is attached to a side of core 12 extending between the first inlet and outlet manifolds 14 and 16. In a similar manner, a second outlet manifold 24 is attached to a side of core assembly 12 oppositely disposed from the second inlet manifold 22. The second inlet manifold 22 may include single inlet opening 26, while the second outlet manifold 24 includes a corresponding single outlet opening 27. A fluid passageway B may extend through the core assembly 12 from inlet 26 to outlet 27. It is considered within the scope of the present invention to have a one, two or more than two parallel fluid passageways B extending through core assembly 12. Likewise, it is within the scope of the present invention to employ a single fluid passageway A similar in design to fluid passageway B rather then employing parallel passageways A and A'.

The fluid passageways A, A' and B are shown as extending approximately ninety degrees (90°) to each other, forming a cross-flow condition between fluids flowing through core 12. However, the fluid passageways A. A' and B may extend parallel to each other, creating a parallel-flow condition between the fluids. Alternatively, the fluid passageways A, A' and B may extend in opposite directions to each other, creating a counter-flow condition between the fluids. Regardless of the relative flow directions of the passageways A, A' and B within core assembly 12, the heat exchanger 10 is fabricated and assembled in a weld-free manner.

Figure 1B:
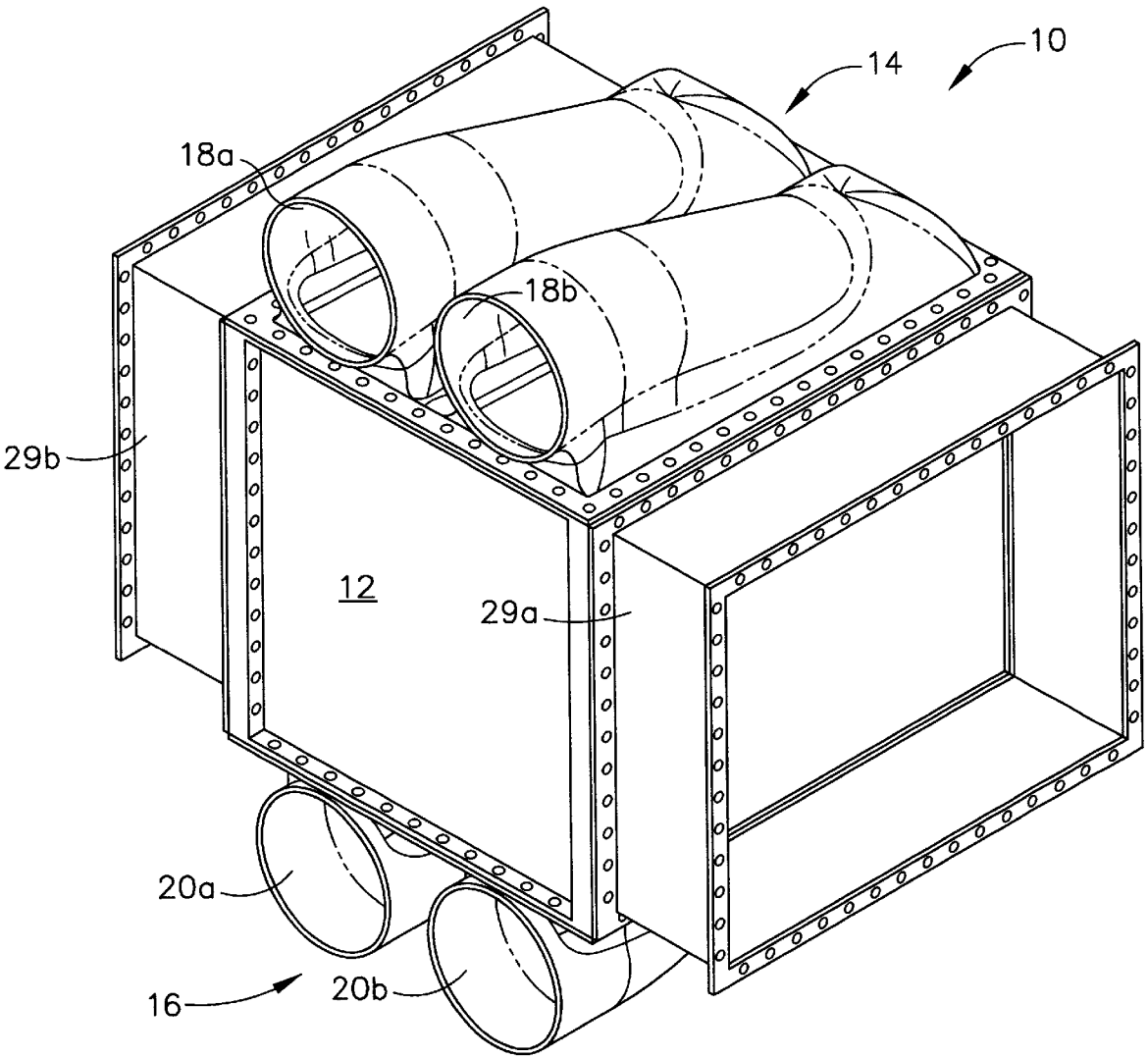

While the embodiment in FIG. 1*a* shows separate manifolds on opposite sides of core assembly 12, it is within the scope of the present invention to attach the core assembly 12 directly to duct work as represented by plenums 29*a* and 29*b* in FIG. 1*b*, thereby completely eliminating at least one pair of manifolds. Alternatively, the heat exchanger 10 could be mounted at the intersection of two pairs of plenums, completely eliminating the need for any manifolds.

Figure 2A:
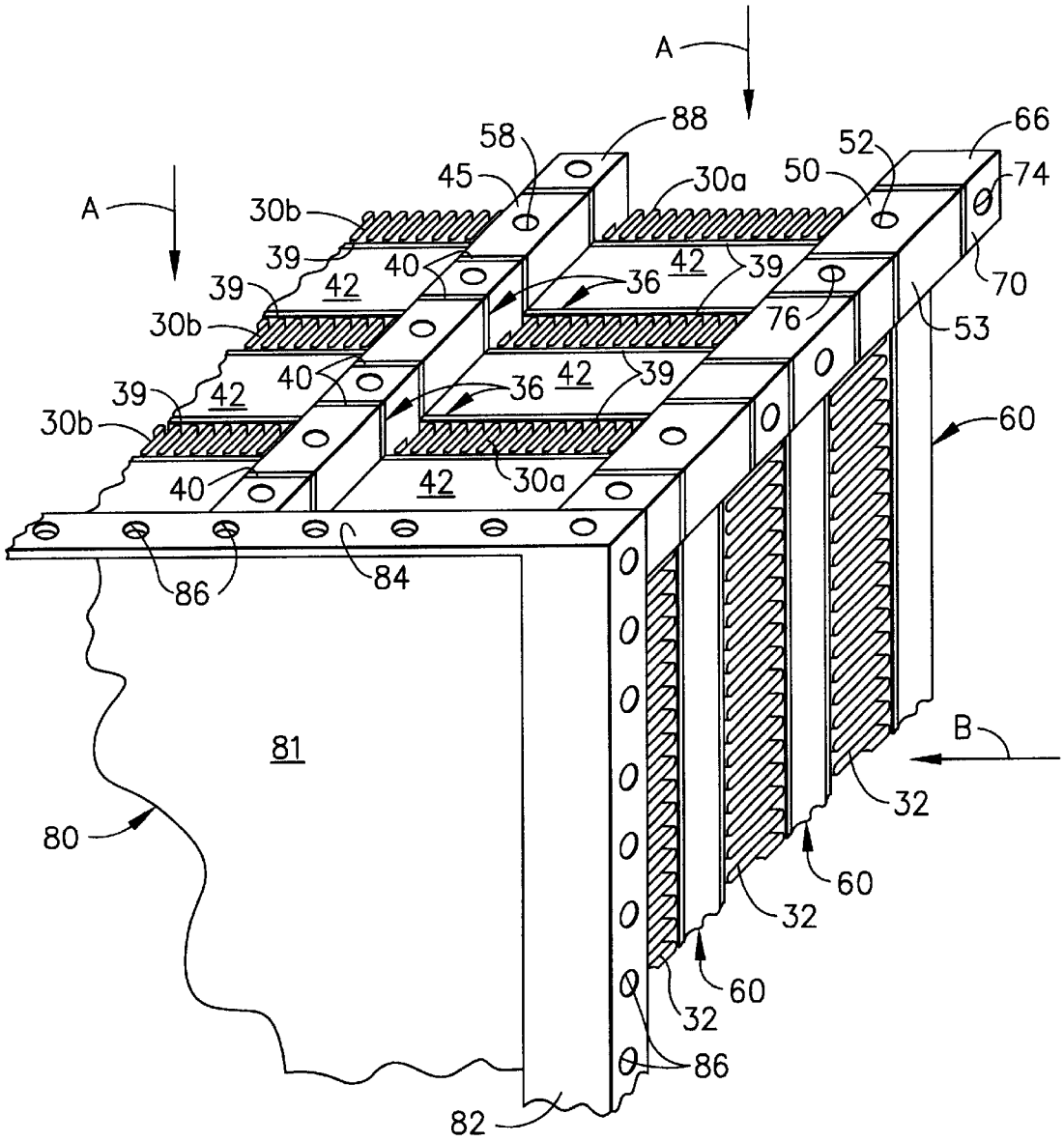
FIG. 2*a* is a perspective view partly in section of the core assembly forming the heat exchangers of FIGS. 1*a* and 1*b*, respectively.
Figure 2B:
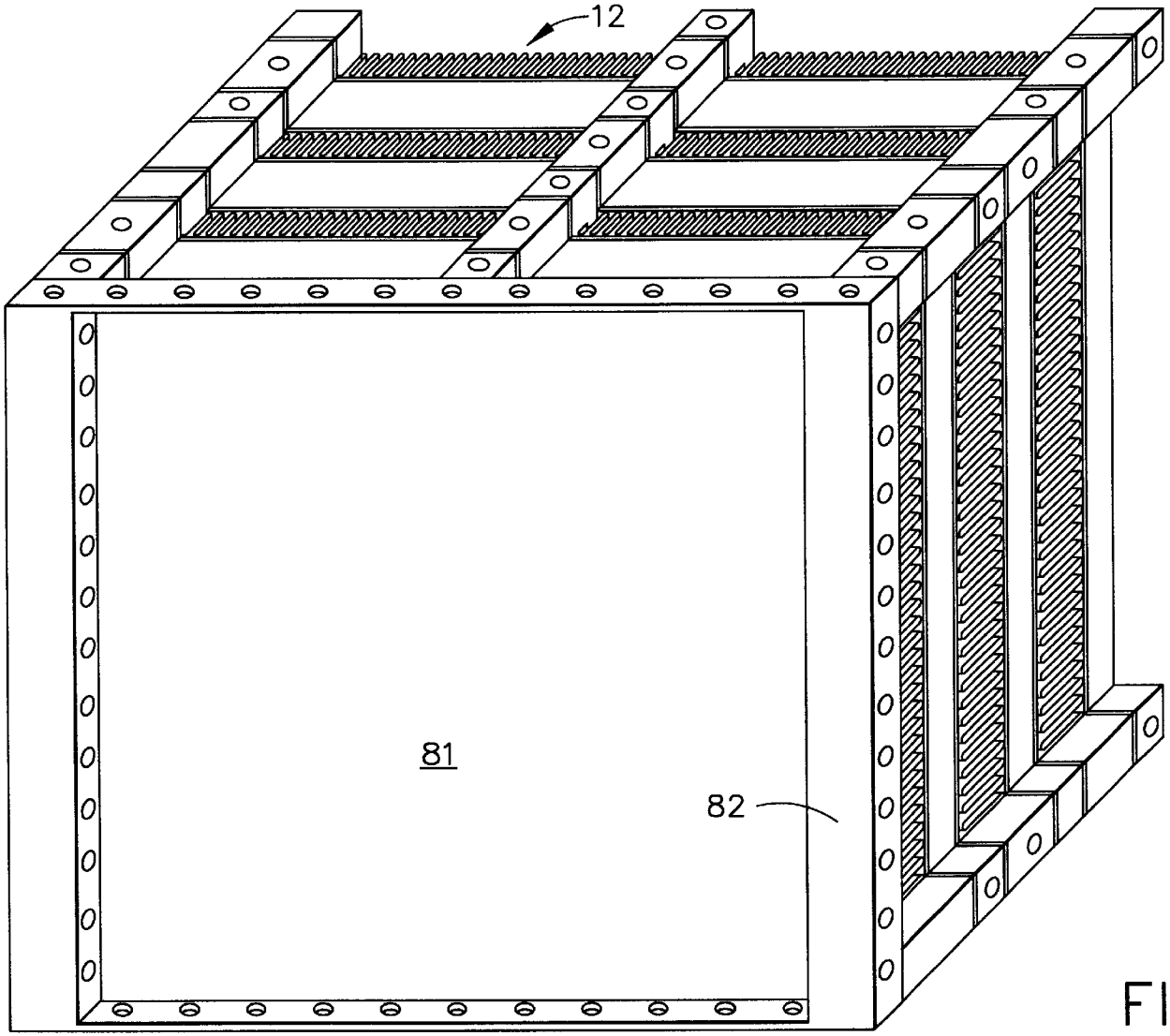
FIG. 2*b* is a perspective view of entire core assembly partially shown in FIG. 2*a;*

Turning now to FIGS. 2*a* and 2*b*, the fluid passageways A and A' are each formed by a number of similar fin assemblies 30*a* and 30*b*, respectively, extending parallel to one another. Each fin assembly 30*a* and 30*b* comprises at least one elongated fin that is, in turn, created from at least one corrugated piece of metal bent into a number of substantially parallel extending, interconnected fin portions. The specific shape of each elongated fin is considered entirely a design choice. While the fin assemblies 30*a* and 30*b* in FIG. 2*a* each show an elongated fin having fin portions extending substantially parallel to one another, the fin portions could be slanted relative to one another if desired. Likewise, the elongated fins could be formed from a number of separate pieces of metal.

In a similar manner, fluid passageway B includes of a number of parallel extending fin assemblies 32. A pair of parallel extending fin assemblies 32 is disposed on opposite sides of each fin assembly 30*a* and 30*b*, respectively. Each fin assembly 32 includes at least one elongated fin having a number of portions extending substantially parallel to one another. Alternatively, the elongated fins forming each fin assembly 32 may include portions slanted relative to one another and/or formed of a number of separate pieces joined together. In this manner, the first and second set of fin assemblies 30*a*, 30*b* and 32 may be stacked one upon the other to form core assembly 12. Each pair of adjacent fin assemblies 30*a*, 30*b* and 32 allows for the exchange of heat to occur between fluids flowing through either or both of the fluid passageways A, A' and B.

Figure 5:
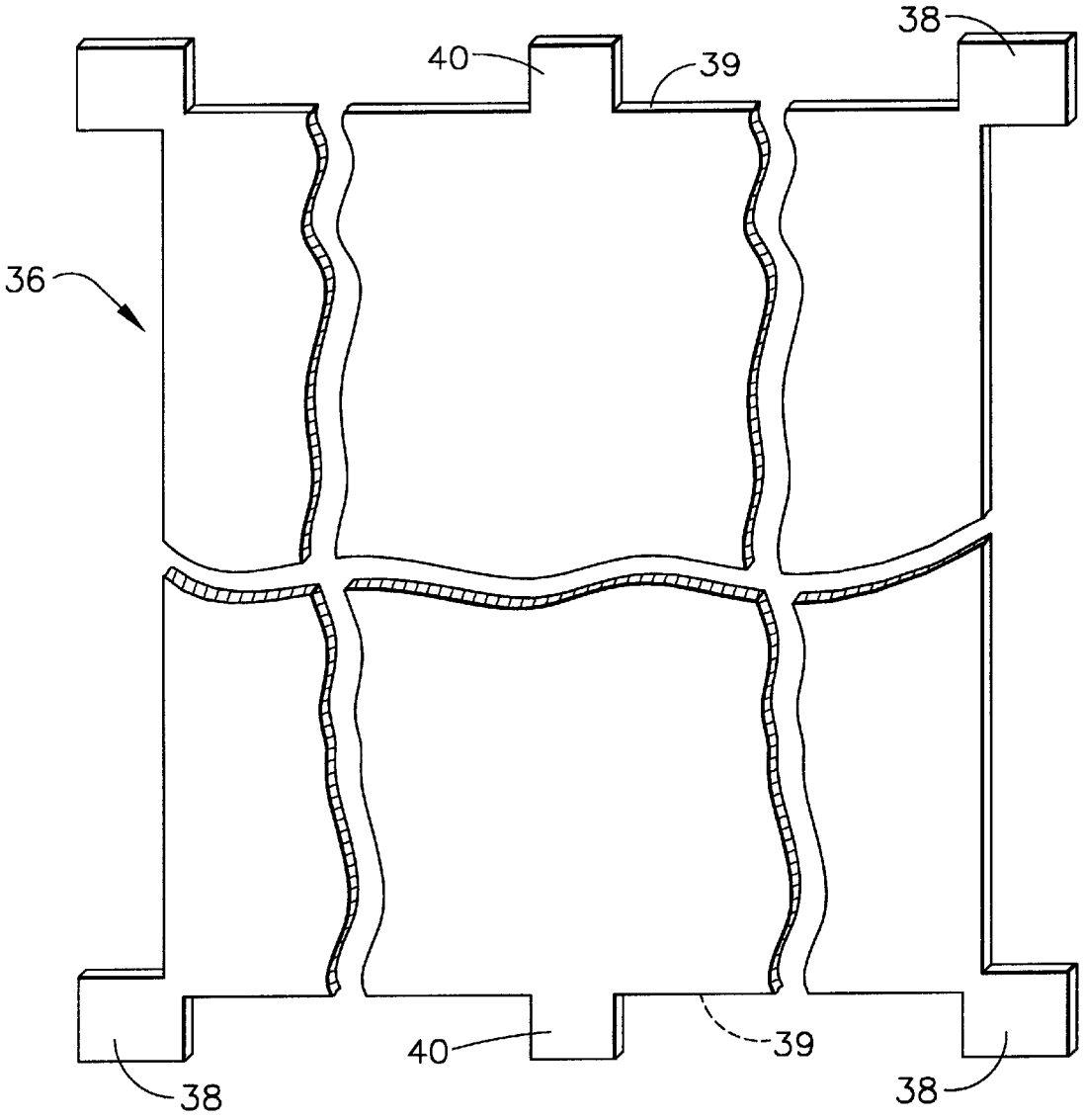
FIG. 5 is a side view of a support plate incorporated into the core assembly shown in FIG. 2*b;*

Referring to FIGS. 2*a* and 5, core assembly 12 further includes a plurality of separate support plates 36, wherein each support plate 36 is positioned between a pair of adjacently disposed fin assemblies 30*a*, 30*b* and 32, respectively. The separate support plates 36, also know as tubesheets, serve to maintain separate flow in each of the fluid passageways A, A' and B. In addition, each support plate 36 functions to support a pair of fin assemblies 30*a* and 30*b* and 32 in their proper positions within core assembly 12. Each corner of each support plate 36, as shown in FIG. 5, preferably includes a rectangular-shaped corner portion 38. In addition, each support plate 36 has a pair of opposite sides 39 having oppositely disposed enlarged portions 40. Preferably, the enlarged portions are of substantially rectangular configuration and are located on each side 39 at the meeting of fluid passageways A and A'. The function of the corner portions 39 and enlarged portions 40 will become clear from the following discussion.

Figure 3A:
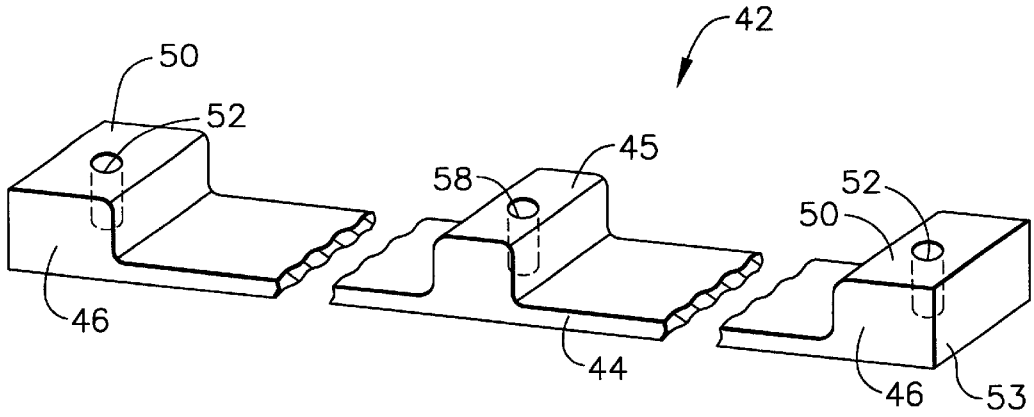
FIGS. 3*a*, 3*b*, 3*c* and 3*d* are side views of enclosure bars incorporated into the heat exchanger core assembly shown in FIG. 2*b;*
Figure 6:
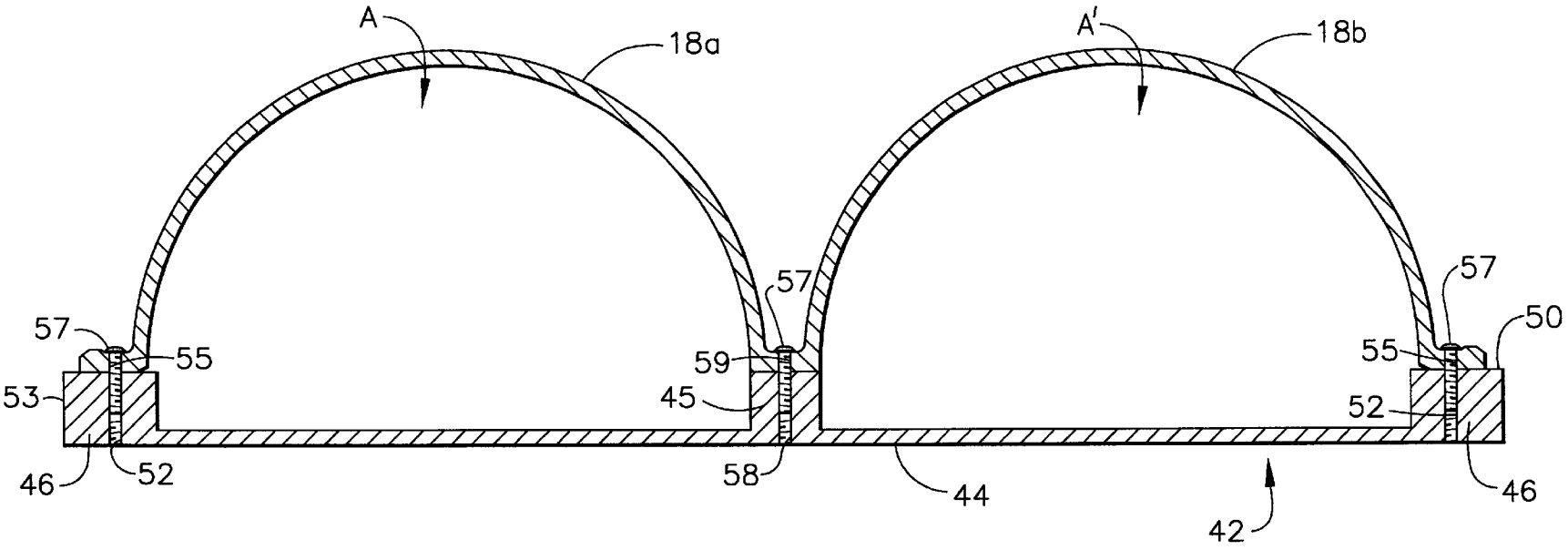
FIG. 6 is a side view of the inlet manifold mounted on the core assembly in the invention according to FIG. 1*a;*

As shown in FIGS. 2*a* and 2*b*, each fin assembly 30*a* and 30*b* is separated from an adjacent fin assemblies 30*a* and 30*b* by a separate enclosure bar 42. Each enclosure bar 42 functions as an end surface for a separate fin assembly 32 as well as providing a surface for attaching one of the manifolds 14 or 16 to core assembly 12. As shown in FIG. 3*a*, each enclosure bar 42 includes an elongated connecting portion 44 of substantially rectangular configuration. Each enclosure bar 42, as shown in FIGS. 2*a* and 6, further includes a raised or enlarged intermediate portion 45 of substantially rectangular configuration disposed on connecting portion 44 at the juncture of fluid passageways A and A'. Each enclosure bar 42 also includes a pair oppositely disposed, enlarged end portions 46. Each end portion 46 has a substantially rectangular-shape. As with the raised intermediate portion 45, each of the enlarged end portions 46 provides a support surface for attachment to a manifold 14 or 16. As shown in FIG. 6, the first inlet manifold 14 is supported by and attached to the enlarged portions 45 and 46 of enclosure bar 42.

As shown in FIG. 3*a*, the rectangular-shaped end portions 46 of at least some of the enclosure bar 42 include a surface 50 on the same side of enclosure bar 42 as intermediate portion 45 having one or more apertures 52 extending at least partially through end portion 46. Each of the end portions 46 also includes an outer surface 53 facing away from intermediate portion 45. Certain of the enclosure bars 42 may contain one or more apertures 54 extending from surface 53 at least partially through end portion 46, as best shown in FIG. 3*b*.

Referring again to FIG. 6, the first inlet manifold 14 includes oppositely-disposed end portions 55, each having a plurality of through apertures 56. When the first inlet manifold 14 is properly positioned adjacent core assembly 12, the apertures 56 extending through manifold 14 are aligned with the apertures 52 extending through the end portions 46 of the enclosure bars 42. This allows for insertion of a separate fastener 57 through selective pairs of aligned apertures 56 and 52 to mechanically join manifold 14 with at least some of the enclosure bars 42. The actual number of pairs of aligned apertures 56 and 52 receiving a fastener 57 is considered a design choice. As shown in FIG. 3*a*, an aperture 58, similar to apertures 52, extends through enlarged portion 45 of enclosure bar 42. When the first inlet manifold 14 is properly aligned adjacent to the core assembly 12, an aperture 59 extending through a connecting portion 71 in manifold 14 will align with enclosure bar aperture 58. This alignment allows separate fastener 57 to be inserted through the aligned apertures 58 and 59, drawing the first inlet manifold 14 into further mechanical engagement with the enclosure bars 42. In a similar manner, the outlet manifold 16 also may be secured to selected enclosure bars 42.

Figure 3C:
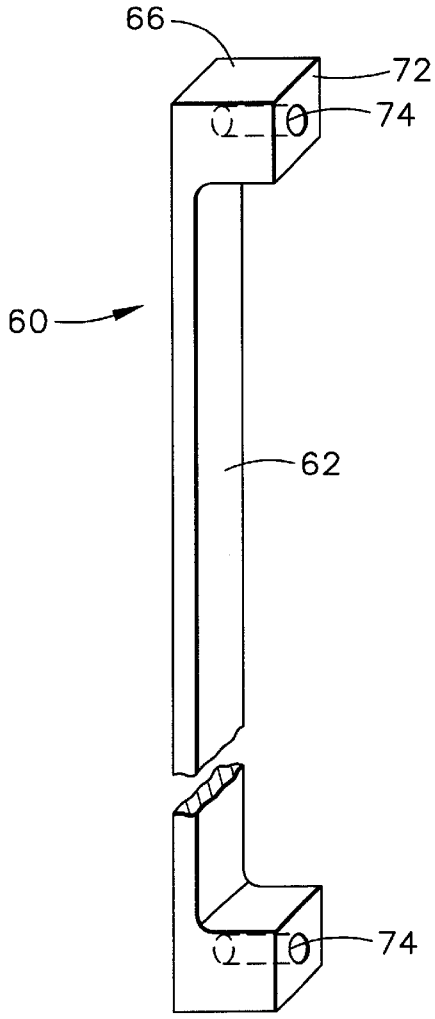
Figure 3B:
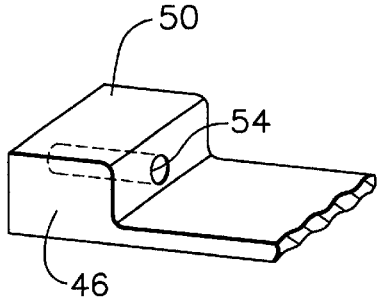
Figure 3D:
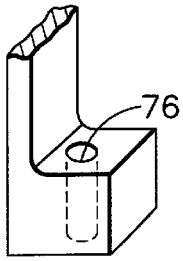

A further plurality of separate enclosure bars 60, as shown in FIGS. 2, 3*c* and 3*d*, are spaced between end portions of each of the fin assemblies 32. Each of the enclosure bars 60, in a manner similar to enclosure bars 42, functions as an end surface to one of the fin assemblies 30*a* and 30*b* as well forming an attachment surface for joining core assembly 12 to either of the manifolds 22 or 24. Enclosure bars 60 are substantially similar in shape to enclosure bars 42 without the presence of raised mid portions 45. Each enclosure bar 60 preferably includes a connecting portion 62 joining a pair of oppositely disposed, enlarged end portions 66 of substantially rectangular configuration. As shown in FIG. 3*c*, opposite end portions 66 are of increased thickness as compared to the thickness of connecting portion 62. Selected enclosure bars 60 may have apertures 74 extending through end portions 66 in a direction perpendicular to connecting portion 62. Alternatively, as shown in FIG. 3*d*, certain enclosure bars 60 may have apertures 76 extending through the enlarged end portions 66 in a direction parallel to connecting portion 62. The apertures 74 and 76 allow enclosure bars 60 to be mechanically attached by conventional fasteners, not shown, inserted through aligned apertures in the enclosure bars 60 and one of the manifolds 14, 16, 22 or 24, respectively.

Figure 4:
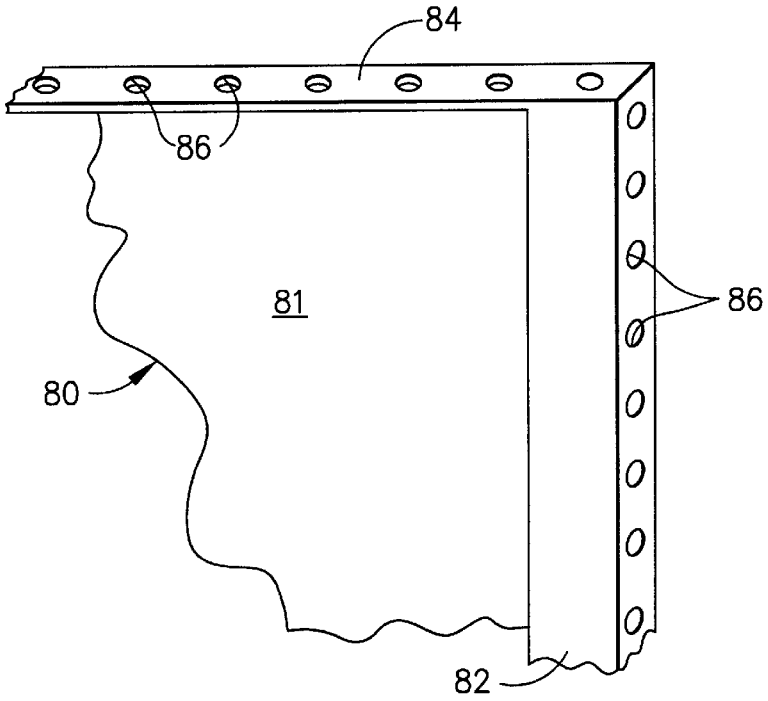
FIG. 4 is a perspective view of a side plate incorporated into the heat exchanger core assembly shown in FIG. 2*b;*

A side or end plate assembly 80, shown in FIG. 4, includes a rectangular plate or sheet 81 bounded by alternating arm portions 82 and 84. As shown in FIG. 2*a*, the side plate assembly 80 is positioned adjacent an end of the core assembly 12, wherein arm portion 82 extends parallel to enclosure bars 60, while arm portion 84 extends parallel to enclosure bars 42. It is within the scope of the present invention to reverse the position of arm portions 82 and 84. Regardless of position, each of the arm portions 82 and 84 includes a plurality of aligned openings 86 adaptable for receiving fasteners 57 to mechanically attach the manifolds 14, 16, 22 and 24 to either of the arm portions 82 or 84, respectively. While only a single side plate assembly 80 is shown in FIG. 2*a*, it is to be understood that separate side plate assemblies 80 may be disposed at each side of core assembly 12 not connected to a manifold. The particular arrangement of openings 86 extending through arm portions 82 and 84 is also considered a design.

Before the heat exchanger 10 is assembled, apertures 52, 54, 58, 74 and 76 are preferably drilled within the enclosure bars 42 and 60 and manifolds 14, 16, 22 and 24. Apertures 86 are drilled in the side plate assemblies 80. This assures that the manifolds may be aligned and mechanically attached to the enclosure bars 42 and 60 as well as to side plate assemblies 80 without any misalignment or slippage that might otherwise occur if the holes were drilled in the enclosure bars 42, 60 and side plates 80 after the components are first brazed to form unitary core assembly 12. Alternatively, it is within the scope of the present invention to drill the apertures in enclosure bars 42 and 60 after the core assembly is brazed.

Once the enclosure bars 42, 60; the side plates 80; fin assemblies 30, 32 and support plates 36 are fabricated and the apertures drilled, the components are assembled to form the core assembly 12. The various fin assemblies 30*a*, 30*b* and 32 and support plates 36 are interposed to form fluid passageways A, A' and B. The rectangular corner portions 38 of the support plates 36 are aligned with the rectangular end portions 46 and 66 of the enclosure bars 42 and 60, respectively, when assembling the core assembly 12. After the core assembly 12 is assembled, it is preferably brazed to form a unitary structure.

Once the brazing operation is complete, the core assembly 12 is attached to the inlet and outlet manifolds 14, 16, 22 and 24. When the manifolds 14,16, 22 and 24 and the core are assembled, they will have a plurality of aligned openings, allowing fasteners 57 to be inserted to mechanically secure the manifolds to the core assembly. The fasteners 57 may, for example, be bolts extending into blind bore holes or rivets extending completely through an opening in one of the end portions. Because the enclosure bars 42 and 60 form a unitary core assembly 12, it is within the scope of the present invention to only secure certain of the enclosure bars 42 or 60 to one of the manifolds 14, 16, 22 or 24, respectively. Likewise, any conventional threaded fastener may be substituted for the bolts or rivet fasteners. Gaskets or other conventional sealing material maybe placed between a manifold and core assembly 12 during the attachment process to minimize joint leakage.

Figure 7:
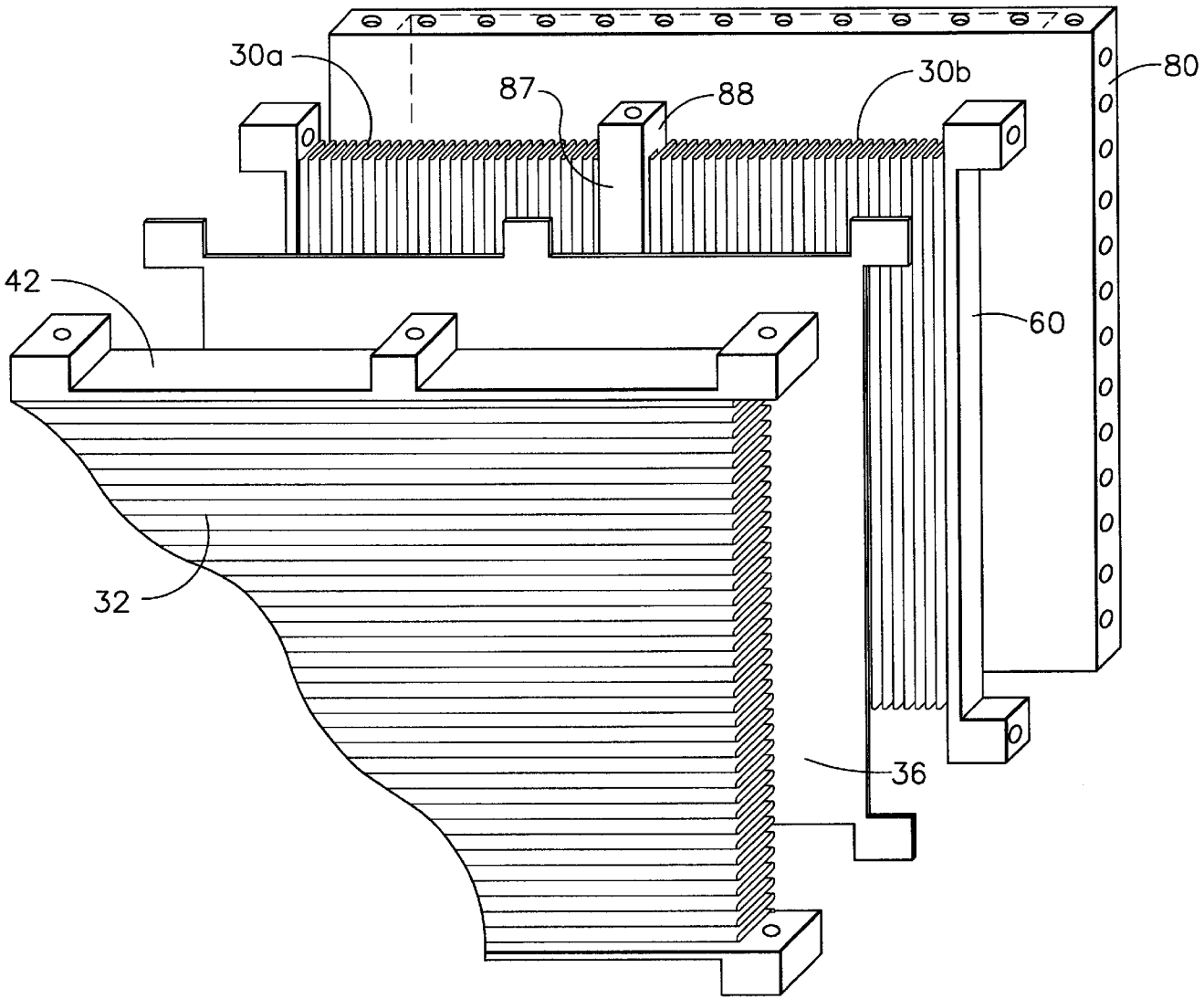
FIG. 7 is an exploded view of the fin plate assembly and supporting members forming a portion of the core assembly in the invention according to FIG. 1*a*.

In order to achieve separate flow passageways A and A', separate pairs of fin plate assemblies 30*a* and 30*b* may be disposed side-by-side, as shown in FIG. 7. An interpass bar 87 positioned between each pair of fin assemblies 30*a* and 30*b* serves to support the fin assemblies while preventing fluid from bleeding between passageways A and A'. Each interpass bar 86 is formed with an elongated connecting portion and a pair of end portions 88 of substantially rectangular configuration. As previously stated, separate enclosure bars 60 are positioned on either end of assembly formed by fin plates 30*a* and 30*b*, respectively.

Preferably, all the enclosure and interpass bars 42, 60 and 87 are extruded, machined and drilled before final assembly.

While the enclosure and interpass bars 42, 60 and 87 have substantially rectangular-shaped end and mid portions, these shapes are considered design choices and other shapes may be employed to provide adequate manifold attachment surfaces.

The heat exchanger 10 may be used for different applications. One such application is an ECS of an aircraft. A typical aircraft ECS cools and conditions incoming bleed air before circulating it throughout the aircraft cabin.

Figure 8:
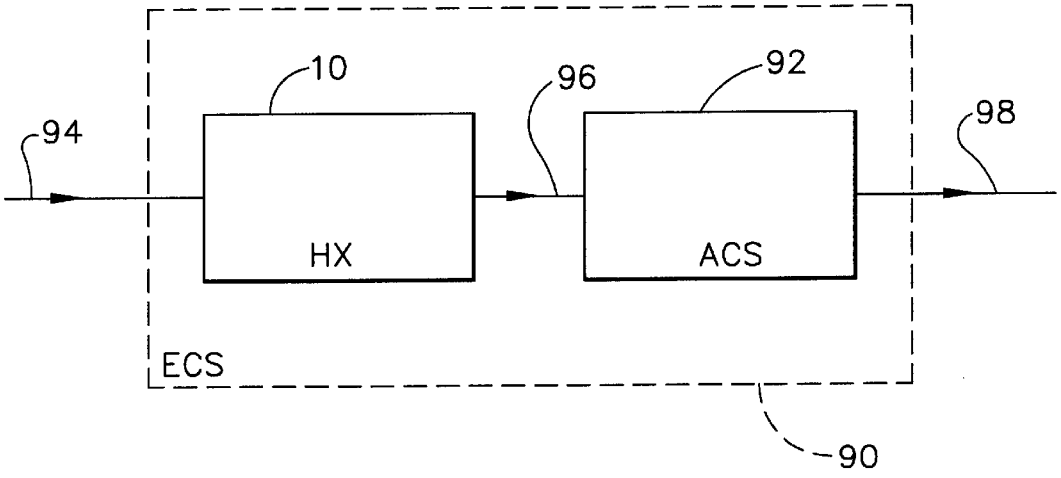
FIG. 8 is a block diagram of an aircraft ECS including the heat exchanger in accordance with the present invention.

FIG. 8 shows an ECS 90 including the heat exchanger 10 formed in accordance with the present invention and an air conditioning system 92. Hot, compressed air is supplied by passageway 94 to the hot side passageway(s) of the heat exchanger 10. The hot compressed air may be bleed air from a compressor stage of an aircraft engine. During operation of the ECS 90, ambient air may flow through the cold side passageway(s) of the heat exchanger 10 to remove the heat of compression from the compressed bleed air. After the bleed air leaves heat exchanger 10 via a passageway 96, it passes through the air conditioning system 92. A typical air conditioning system 92 includes an air cycle machine for expanding and cooling the bleed air, and a water extractor for removing water entrained in the bleed air. Cooled and conditioned air leaving the air conditioning system 92 is passed through an outlet passageway 98 to an aircraft cabin or other closed compartment.

The present invention may be used anywhere a fluid-to-fluid heat exchanger is utilized. The heat exchanger assembly 10 can handle a range of fluid temperatures from hot exhaust gases to cryogenic fluids.

The present invention has been described with reference to specific preferred embodiments thereof, it will be appreciated by those skilled in the art that upon a reading and understanding of the foregoing numerous variations to the preferred embodiments may be attained which, nonetheless, lie within the spirit and scope of the appended claims. For instance, the is number of openings formed in the manifolds 14, 16, 22 and 24 is considered a design choice.

While the fluid passageways A, A' and B are each illustrated as making a single pass through the heat exchanger 10, it is within the scope of the present invention to form a multi-pass heat exchanger having appropriately positioned headers for rerouting the fluids through the core assembly. Whether a single or multi-pass heat exchanger is desired, the unique arrangement and configuration of the components making up the present invention and the method of assembly provide a weld-free heat exchanger assembly that is more cost effective than known assemblies.

What is claimed is:

1. A fluid-to-fluid heat exchanger assembly, comprising:

a core assembly including at least two adjacently disposed fin assemblies; said core assembly further including a support plate located between said adjacently disposed fin assemblies, said core assembly further including an enclosure bar retained at opposite ends of at least one of said fin assemblies, said enclosure bar having at least one through aperture;

at least one enclosure positioned adjacent said core assembly for directing fluid through said core assembly, said enclosure having at least one through aperture aligned with at least one through aperture in said enclosure bar; and at least one mechanical fastener extending through said aligned apertures for joining said enclosure to said enclosure bar.

2. The heat exchanger assembly according to claim 1, wherein said core assembly includes a plurality of stacked fin assemblies, with a separate support plate located between each adjacent pair of stacked fin assemblies and separate enclosure bars secured to opposite ends of each stacked fin assembly.

3. The heat exchanger assembly according to claim 2, wherein said enclosure comprises a pair of separate manifolds, with each manifold positioned on an opposite side of said core assembly, with each manifold and said core assembly forming at least one fluid passageway through said heat exchanger assembly, at least one mechanical fastener securing each manifold to an enclosure bar.

4. The heat exchanger assembly according to claim 2, wherein each enclosure bar includes a pair of oppositely disposed, enlarged end portions, with at least one of said apertures extending at least partially therethrough.

5. The heat exchanger assembly according to claim 4, wherein the enlarged end portions of each of said enclosure bars are substantially rectangular in configuration and are stacked.

6. The heat exchanger assembly according to claim 4, wherein a plurality of said enclosure bars each includes an enlarged intermediate portion located between said end portions and adaptable for supporting one of said manifolds, said enlarged intermediate portion having an aperture for receiving a mechanical fastener.

7. The heat exchanger assembly according to claim 4, wherein each support plate includes a plurality of corner portions similar in cross-sectional configuration to the end portions of said enclosure bars, with each support plate corner portion positioned between the end portions of two adjacently disposed enclosure bars when assembled.

8. A weld-free heat exchanger assembly, comprising:

a core assembly including a plurality of separate fin assemblies stacked one upon another;

a separate support plate spaced between each pair of adjacent fin assembles;

a separate enclosure bar secured at the end of each fin assembly said enclosure bar having at least one through aperture;

an inlet manifold positioned adjacent said core assembly and an outlet manifold positioned adjacent said core assembly, said manifolds and core assembly forming at least a first fluid flow passageway through said heat to exchanger assembly; and at least one mechanical fastening assembly extending through at least one aperture in said enclosure bar for joining each manifold to said enclosure bar.

9. The heat exchanger assembly according to claim 8, wherein each enclosure bar includes a pair of oppositely disposed, enlarged end portions of similar size.

10. The heat exchanger assembly according to claim 9, wherein each support plate includes a plurality of corner portions similar in size and cross-sectional configuration to the end portions of said enclosure bars.

11. The heat exchanger assembly according to claim 9, wherein said fastening assembly includes a plurality of fasteners, each fastener extending through at least one aperture formed in each enlarged end portion of one of said enclosure bars and aligned with a corresponding aperture in one of said manifolds.

12. The heat exchanger assembly according to claim 8, further comprising a second inlet manifold adjacent said core assembly and a second outlet manifold adjacent said core assembly, said second manifolds and the core assembly forming at least a second fluid flow passageway.

13. An enclosure bar for a heat exchanger assembly, the bar comprising:

a substantially flat, elongated intermediate portion; and enlarged first and second end portions of similar size, the end portions having manifold mounting surfaces, at least one end portion having an aperture extending therethrough to the mounting surface.

14. An environmental control system, comprising:

an air conditioning system; and a weld-free heat exchanger having an outlet connected to an inlet of the air conditioning system;

said heat exchanger including a core assembly of substantially rectangular configuration and formed by a plurality of separate fin assemblies stacked upon one another;

said heat exchanger further including a plurality of separate support plates, each support plate being positioned between and supporting a pair of adjacent fin assemblies;

said heat exchanger further including a plurality of separate, substantially rectangular-shaped enclosure bars, each enclosure bar being secured to an end of each fin assembly, each enclosure bar including a pair of enlarged end portions, each end portion having at least one aperture extending therein;

said heat exchanger further including a separate manifold positioned adjacent each side of said core assembly, wherein each pair of manifolds and said core form a plurality of fluid flow passageways through said heat exchanger assembly; and the manifolds being mechanically fastened to said enclosure bars.

15. The environmental control system according to claim 14, wherein a plurality of apertures extend at least partially through each manifold, each manifold aperture being aligned with a corresponding aperture in an enlarged end portion of an enclosure bar, wherein a fastening member extends through each pair of aligned apertures.

16. The environmental control system according to claim 15, wherein each of said fastening members includes a threaded screw and each of said apertures formed in said enlarged end portions includes a threaded portion adaptable for receiving a threaded portion of said threaded screw.

17. A method of forming a heat exchanger assembly, comprising the steps of:

interposing a plurality of first and second fin-plate assemblies to form at least two separate fluid passageways extending through two separate fin-plates assemblies;

positioning a separate support plate between each pair of adjacently disposed first and second fin-plate assemblies;

positioning a separate enclosure bar having at least one through aperture at the end of each first and second fin-plate assemblies to maintain the spacing of said fin plates assemblies and prevent fluid from leaking from said two separate fluid passageways;

brazing said first and second fin-plate assemblies, support plates and enclosure bars into a unitary core assembly;

mechanically joining at least one fluid passageway enclosure to enclosure bars of the core assembly, through at least one aperture in said enclosure bar thereby forming a weld-free heat exchanger assembly.

18. The method of forming a heat exchanger according to claim 17, further including the step of forming at least on aperture in each enclosure bar before brazing said enclosure bars to said fin plate assemblies.

19. The method of forming a heat exchanger according to claim 17, further including the step of mechanically joining a separate manifold to each side of said core assembly to form a weld-free attachment.

20. The method of forming a heat exchanger according to claim 19, further including the step of mechanically joining the manifolds to the enclosure bars by a plurality of bolts extending through aligned openings formed in adjacent portions of the manifolds and enclosure bars.

* * * * *